United States Patent [19]

Garvey et al.

[11] Patent Number: 4,995,995

[45] Date of Patent: Feb. 26, 1991

[54] LUBRICANT COMPRISING AN OIL-IN-WATER EMULSION, A PROCESS FOR THE PREPARATION THEREOF AND THE USE OF THE LUBRICANT

[75] Inventors: Michael J. Garvey, Heswall; Ian C. Griffiths, Bebington; Ian Thompson, Chester, all of Great Britain

[73] Assignee: Unilever Patent Holdings B.V., Netherlands

[21] Appl. No.: 247,090

[22] Filed: Sep. 20, 1988

[30] Foreign Application Priority Data

Sep. 21, 1987 [EP] European Pat. Off. ..... 87201792.6

[51] Int. Cl.[5] ..... C10M 125/26; C10M 173/00

[52] U.S. Cl. ..... 252/28; 252/49.5; 252/73; 72/42

[58] Field of Search ..... 252/49.5, 28, 73; 72/42

[56] References Cited

U.S. PATENT DOCUMENTS

| | | | |
|---|---|---|---|
| 3,454,495 | 7/1969 | Schneider | 252/28 |
| 3,856,686 | 12/1974 | Sato et al. | 252/28 |
| 3,948,784 | 4/1976 | Krillic et al. | 252/49.5 |
| 4,148,970 | 4/1979 | McIntosh et al. | 252/49.5 |
| 4,490,281 | 12/1984 | James et al. | 252/49.5 |

*Primary Examiner*—William R. Dixon, Jr.
*Assistant Examiner*—Ellen M. McAvoy
*Attorney, Agent, or Firm*—Cushman, Darby & Cushman

[57] ABSTRACT

A lubricant comprising an oil-in-water emulsion and solid particles, in which the oil is a lubricating material and the oil droplets are stabilized by a surface coating of partially hydrophobic silica particles of a size less then 1 micrometer. This lubricant is to be used as a hydraulic fluid and as a metal-working or metal-rolling fluid.

18 Claims, No Drawings

LUBRICANT COMPRISING AN OIL-IN-WATER EMULSION, A PROCESS FOR THE PREPARATION THEREOF AND THE USE OF THE LUBRICANT

The invention relates to a lubricant comprising an oil-in-water emulsion in which the oil is a lubricating material. More in particular the invention relates to such emulsions with droplets having a controlled degree of instability, and to a process for the preparation of such a lubricant and to the use of the lubricant or the oil-in-water emulsion as a hydraulic fluid, a metal working, or metal-rolling fluid.

Lubricating formulations containing an oil, solid particles and water are known from European patent application No. 33,170. In this patent application a hydraulic fluid has been disclosed being an oil-in-water emulsion that comprises 90–99 weight % of water, from 0.5–5 weight % of a lubricating oil and an emulsifier. In the description it has been indicated that the viscosity can be increased by adding a thickener which might be a water-soluble polymer, fumed silicas and aluminas. In the claims and in the examples no attention has been given to the use of the inorganic thickeners, but when the thickeners are used their purpose is to thicken the aqueous phase.

From U.S. Pat. Nos. 2,722,515, 2,628,197 and British patent No. 858,863 emulsions are known in which the oil component is emulsified in water with the aid of a soap or surfactant (emulsifier). The solid particles are present either dispersed throughout the bulk of the emulsified oil droplets or dispersed in the aqueous phase. In the former case the solid particles act as a thickener or filler for the oil or as an abrasive (see U.S. Pat. No. 2,112,632). In U.S. Pat. No. 3,454,495 a lubricant composition has been disclosed for use in the cold forming of metals, which composition comprises a liquid phase and a solid phase, the solid phase being dispersed in the liquid phase. The porous solid can consist of finely divided aluminum hydroxide impregnated with molten polyolefin which is quite different from the composition according to the invention.

In British patent Nos. 952,351 and 952,352 emulsions have been disclosed which can be used as a medium in which the polymerization of ethylenically unsaturated polymers can be polymerized.

The lubricant according to the invention, comprises an oil-in-water emulsion and solid particles, in which the oil is a lubricating material, is characterized in that the oil droplets are stabilized by a surface coating of partially hydrophobic silica particles of a size less than 1 micrometer. Lubricating compositions containing silica particles which act as an emulsifier and which are located at the surface of oil droplets are novel.

There has been a need for fire resistant fluids with lubricating properties especially for applications where there is a possible risk from fire. It proved to be difficult to obtain emulsions with a controlled degree of instability permitting the droplets to be stable in the bulk of the dispersion and yet with a triggered instability on contacting a surface so as to form a lubricating oil film thereon.

The present invention provides an oil-in-water emulsion with silica particle coated droplets wherein the droplets comprise lubricating material. For a suitable degree of stability of the emulsion, partial hydrophobing of the silica particles may be recommendable so that the silica particles are rendered sufficiently hydrophobic to hold them at the oil-water interface.

In a preferred embodiment of the invention the solid particles comprise colloidal silica, which has been rendered partially hydrophobic by treatment of the silica particles with a silating agent e.g. trimethyl chlorosilane or an organic cationic compound. The use of quarternary ammonium compounds, such as e.g. cetyl trimethyl ammonium bromide for this purpose is particularly recommended.

The use of an amount of solid particles in the emulsion in the range between 0.01 and 25, preferably between 0.02 and 10% (w/w) was found useful. Also the size of the solid particles was found to be important and the use of solid particles having in at least one direction a size between 0.003 and 1, preferably between 0.005 and 0.5 micrometer was found beneficial. Ideally the concentration of particles in the emulsion should be low enough to be substantially depleted from the aqueous phase onto the droplets of the emulsion.

One convenient way of preparing a suitable colloidal silica sol is by mixing a colloidal silica with a cationic surfactant solution at a concentration of the surfactant low enough to prevent visible aggregation of the silica. In the surface active silica sol so obtained subsequently a suitable lubricating oil is homogenized.

The lubricating oil phase comprises a molecule having at least 10 carbon and/or silicon atoms and compounds of the class consisting of mineral oil, ester, ether, polyalpha-olefin, silicone oil, derivatives and mixtures thereof are very suitable. Organic esters, in particular esters derived from a polyol with a tertiary alpha carbon atom such as trimethylolpropane, trimethylolethane, pentaerythritol are preferred, especially if the carboxylic acid constituent is a C6-C22 (mainly straight chain) monocarboxylic acid. The amount of oil phase (droplets) in the emulsion normally ranges between 0.1 and 70%, preferably between 0.5 and 20% (w/w) of the emulsion. The emulsion may also contain conventional additives that are used in hydraulic and other water based functional fluids. These other additives include corrosion inhibitors, shear stabilizing agents, thickeners, bactericides, dyes, water softening agents, odour masking agents, surfactants, anti-wear additives, de-foamers, extreme-pressure additives and the like. Such additives are readily available and their use is well known to those skilled in the art.

The silica particles forming the coating of the oil droplets, in particular when suitably hydrophobic, have a tendency to condense or polymerize at the oil-water interface to form a permanent, but brittle two dimensional aggregated interfacial skin. For satisfactory performance as a lubricating material it is desirable that the coated droplets of the emulsion, when subjected to distortion or to asymmetric pressure, undergo an irreversible rupturing and thereby form a lubricating film of droplet material on the neighbouring surfaces.

Under certain circumstances it is preferable that the aqueous phase also includes an amount of hydrophobing agent in the range of 0.1 to 100 mg per gram of solid particle. The concentration of hydrophobing agent necessary to render the particle sufficiently hydrophobic to adsorb at the oil water interface is less than that required for monolayer coverage of the particles which is given by the expression $\frac{3}{prAN}$ moles $g^{-1}$ where r is the effective particle radius, p is the particle density, A is the area of the surface occupied by the hydrophobing agent and N is Avogadro's number. The expression approximates to 0.006/r(nm) moles of agent per gram of particles. The amount of agent is, therefore, less than 0.006/r moles of agent per gram of particles where r is the effective particle radius. In practice a few percent of the above amount is used, for example, 0.003 g per gram of silica particles. The present invention also provides a process for preparing an oil-in-water emulsion with silica particle coated droplets with a lubricating material in which a lubricating oil is emulsified in an aqueous phase containing suitable hydrophobic silica particles so as to form an emulsion of droplets coated with a skin of solid particles.

In another embodiment the invention comprises the use of an oil-in-water emulsion as described above as a hydraulic fluid, as a lubricant or as a metal-working fluid.

The invention is illustrated by the following examples

EXAMPLE 1

A partially hydrophobed silica dispersion was prepared by adding 25 g of 0.03% (w/w) cetyl trimethyl ammonium bromide solution to an equal weight of a 10% w/w silica dispersion (Ludox HS40 ex. E.I. De Pont de Nemours & Co.) average silica particle size of approximately 13 nm (0.013 μm) with rapid stirring. The dispersion contained no visible aggregates and had a pH of 9.9.

To 45 g of this dispersion were added 5 g ester ($C_7$-carboxylic ester of trimethylolpropane) and the mixture was homogenised using a Silverson high shear mixer (1.6 cm diameter head, maximum power) for 2 minutes.

The emulsion was examined by optical microscopy which showed the presence of spherical and spheroidal droplets up to 30 micrometer diameter. The emulsion creamed on standing but there was an insignificant amount of coalescence after two days.

EXAMPLE 2

The silica dispersion obtained according to example 1 was diluted fifty fold with distilled water then mixed as in example 1 with the ester to form a 10% w/w oil in water dispersion.

The resulting emulsion creamed rapidly with coalescence to give a layer of oil on the surface of the emulsion. Microscopic examination showed the presence of emulsion droplets, in the aqueous phase, up to approximately 1000 micrometer.

EXAMPLE 3

Example 2 was repeated with high shear mixing (using a Silverson high shear mixer) for 20 minutes. The emulsion creamed without coalescence and from optical microscopy was found to contain droplets up to 200 micrometer.

In order to demonstrate and visualise the phenomena of controlled emulsion stability, the following experiment was performed.

A few drops of the above emulsion were placed on a glass microscope slide, and covered with a glass cover slip. On applying vertical pressure to the microscope slide cover slip, it was observed that deformation of the droplets readily occurred which led to coalescence and rupturing against the glass surfaces.

EXAMPLE 4

25 g of 0.012% w/w cetyl trimethyl ammonium bromide (CTAB) solution was added with rapid stirring to an equal weight of 2% w/w silica dispersion (Ludox SM ex Du Pont de Nemours colloidal silica having an average particle size of approximately 7 nanometers). 5 g of this mixture were then diluted by addition of 45 g distilled water.

To 45 g of this dispersion (0.1% $SiO_2$, 0.006% CTAB) were added 5 g of the above ester followed by homogenisation using a Silverson blender as described in example 1.

Microscopic examination showed the emulsion to contain mainly spherical droplets of size up to 50 micrometer. There was no visible coalescence, but the droplets were observed to rupture when pressure was applied to the microscope cover slip as described above.

EXAMPLE 5

45 g of an aqueous partially hydophobed, silica dispersion were prepared by addition of 22.5 g of 0.0024% w/w cetyl trimethyl ammonium bromide to 22.5 g of 0.8% w/w silica dispersion (diluted Ludox HS40 40% silica) with rapid stirring on a magnetic stirrer for one minute followed by a pH adjustment to pH 7 with concentrated hydrochloric acid. There was no visible aggregation of the silica.

To the above silica dispersion was added 5 g of the ester in example 1 and the mixture homogenised in a 100 $cm^3$ (tall form) beaker using a Silverson mixer, fitted with a 1,6 cm diameter head, on maximum power for 20 minutes.

The emulsion was examined by optical microscopy, which showed droplets up to 50 micrometer in diameter with no visible coalescence. Coalescence of emulsion droplets and rupture against the glass surface could be observed on application of pressure to the microscope slide as described above.

The emulsion was added to an equal weight of a 5% w/w aqueous solution of Blanose Refind CMC X8200 (Hercules, D.s. 2.1MW 50,000) and stirred for 30 minutes using a Heidolph stirrer (PTFE blade) at 300 rpm. Examination by microscopy showed no deterioration of the emulsion.

The emulsion was allowed to stand for 48 hours with no visible creaming but a small number of coalesced oil droplets were observed on the surface.

EXAMPLE 6

Equal weights of a 0.8% w/w silica dispersion (as used in example 1) and 0.0024% w/w cetyl trimethyl ammonium bromide (CTAB) solution were mixed by adding CTAB solution to the silica dispersion with rapid, non turbulent stirring. The pH of this dispersion was reduced by the addition of concentrated HCl to pH 7.0.

5 g of ester (example 1) were emulsified in 45 g of the above dispersion using a Silverson mixer (max power 20 mins) and the resulting emulsion was added to 50 g 1.2% aqueous Guar gum solution (Meypro Guar CSA 200/50 ex. Meyhall Chemical) and stirred for 5 minutes.

This thickened emulsion showed no signs of creaming over a period of 24 hours and on microscopic examination droplets of up to 50 μm were observed that coalesced under pressure.

EXAMPLE 7

A sample of partially hydrophobic silica was prepared by slowly adding a 400 g aqueous solution of 0.15% (w/w) cetyl trimethyl ammonium bromide to 400 g of a 10% (w/w) silica sol (Ludox HS40 ex. Du Pont) whilst subjecting the latter to sonication at full power using a Dawe 7530A Soniprobe.

An emulsion concentrate was prepared by adding 25 g of hindered ester (branched $C_{18}$ ester of pentaerythritol) to 50 g of the partially hydrophobic silica prepared as above. The mixture was subjected to sonication for five minutes at full power using a Dawe 7530A Sonipobe.

The above concentrate was mixed with 425 g of suspending agent, prepared by making up a solution containing 0.1% (w/w) Carbopol 940 (ex. Goodrich) and 0.2% formaldehyde in water, made mildly alkaline (0.04% (w/w) sodium hydroxide).

Thus an emulsion was produced containing droplets of the ester coated by a solid skin, of diameter 0.1–100 μm. Over a period of several months no noticeable creaming occurred.

EXAMPLE 8

An emulsion was prepared by adding ester to hydrophobic silica in the same proportions as in Example 7. The ester used was a dimerate ester, neopentyl glycol 2-ethyl hexyl dimerate, giving the same result as obtained in Example 7.

EXAMPLE 9

An emulsion concentrate was prepared as in example 8. This was diluted with glycerol to form a 5% (w/w) ester emulsion. This was tested for its film forming abilities as follows;

The ability of the emulsion to deposit an elastohydrodynamic (EHD) lubrication film was evaluated using a rolling point contact apparatus. Such apparatus has been used in the study of lubrication, to determine the thicknesses of lubrication films produced by water based fluids. A description of the apparatus used is provided in the literature being G. T. Wan, P. Kenny and H. A. Spikes "Elastohydrodynamic Properties of Water-based Fire-resistant Hydraulic Fluids". Tribology International 17(6), (1984), 309–315 and H. Hamaguchi, H. A. Spikes and A. Camerron "Elastohydrodynamic Properties of Water-in-Oil Emulsions". Wear 43, (1977), 17–24. Briefly, the method relies on the destructive interference produced when coherrent light is reflect from the top and bottom surfaces of a lubricant film. The film is formed between a steel ball bearing and a glass disc which has been coated with a reflective layer of chromium. The contact point is observed using a top-lit microscope, and interference colours in the contact zone identify the presence of an EHD film. Each interference colour corresponds to a specific film thickness; the technique can be used to identify EHD films from 0.1 to 2 um thick.

A sample of the emulsion was placed on the underside of the chromium-plated glass disc. A 1" (2.54 cm) diameter steel ball bearing was placed in contact with the fluid and a load of 29,4N was applied. The disc was then rotated, causing the ball bearing to rotate, and the contact zone was observed under a microscope. The speed required to achieve the first yellow interference colour, which corresponds to a film thickness of 0.14 um, was noted. The results of the film forming abilities are given in table A.

TABLE A

| Sample | Rolling speed to form EHD film/$ms^{-1}$ |
|---|---|
| emulsion of example 9 | $3.84 \times 10^{-3}$ |
| pure ester | $3.86 \times 10^{-3}$ |
| glycerol | $7.74 \times 10^{-1}$ |
| hydraulic fluid | no film formed |
| Standard fully formulated high-water based hydraulic fluid. | |

As can be seen from table A, the solid stabilised emulsion showed the ability to deposit an EHD film at the same rolling speed as the base ester. This implied that the lubricating film deposited from the emulsion consisted of the base ester.

Glycerol, the suspending agent used in example 9, did not form an EHD film until a speed two orders of magnitude higher than required for example 9 were reached.

A standard fully formulated water-based hydraulic fluid, did not show any EHD film formation, although the rolling speed was increased to 3 $ms^{-1}$. Similar experiments on surfactant stabilised oil-in-water emulsion based hydraulic fluids have been reported in the above mentioned literature. They show that EHD films are not formed from these fluids.

EXAMPLE 10

Emulsions were prepared in accordance with examples 1, 7 and 8. They were tested for their lubricating ability using the Falex test. For comparison purposes standard fluids as detailed in table B were also tested.

The lubricating properties of a fluid can be conveniently assessed by means of the Falex Method ("Measuring Wear Properties of Fluid Lubricants (Falex method)" ASTMD 2670-67). The test measures the wear between a rotated shaft and two vee-blocks after a specified period of time.

60–70 $cm^3$ of the test fluid was placed in the cup of the Falex lubricant testing machine (ex. Faville-LeVally Corp., Bellwood, Ill.) equipped with a new test shaft and vee-blocks. The shaft was of diameter 6 mm and constructed from SAE 3135 steel of hardness $R_B$ 87–91 and surface roughness 10 RMS. The vee-blocks (96° block angle) were made from AISI 1137 steel of hardness $R_C$ 20–24 and surface roughness 10 RMS. The vee-blocks were clamped to the shaft by means of two levers, to the ends of which a force was applied using a notched load wheel. This force could be measured using a load gauge.

The vee-blocks were clamped together with a force of 250 lbs, and the surfaces were run-in by rotating the shaft at 290 rpm for five minutes. The test load was then increased to 700 lbs force and the position of the notched wheel noted. The shaft was then rotated for a further fifteen minutes, any wear being taken up by rotating the load wheel. After this time, the load was temporarily reduced to 600 lbs force, then increased to 700 lbs force. The test was then stopped and the number of notches that the wheel had been advanced was noted; this was the Falex wear index. Should the vee-blocks sieze the shaft during the test, a shear pin breaks and the fluid is judged to have "failed".

The results as obtained are shown in table B. a low wear index implies good lubrication.

TABLE B

| Sample | Falex Wear Index |
|---|---|
| 0.1% aqueous carbopol 940 (registered name of Goodrich) | failed |
| mineral oil 200SN | failed |
| pure ester from example 1 | 54 |
| example 1 - emulsion | 14 |
| pure ester from example 7 | 69 |
| example 7 - emulsion | 4 |
| pure ester from example 8 | 61 |
| example 8 - emulsion | 10 |
| Standard fully formulated High Water Based hydraulic fluid | 3 |

As can be seen from the above table B, both aqueous Carbopol (the thickening agent used in examples 7 and 8) and mineral oil without additives proved ineffective lubricants on this test, and the apparatus siezed.

By contrast, the pure esters prevented siezure or severe wear, but more effective still were the solid stabilised emulsions prepared from these esters. Indeed, the wear protection approached that given by a fully formulated hydraulic fluid—a product which includes anti-wear and extreme-pressure additives. No such additives were included in the emulsions tested

EXAMPLE 11

The procedure in example 6 was repeated using equal weights of a 0.8% w/w silica dispersion and 0.005% w/w tetradecyl trimethyl ammonium bromide. The resulting emulsion containing droplets of up to 50 micrometer was observed to coalesce under pressure on a microscope slide.

EXAMPLE 12

25 g of 0.012% w/w hexadecyl trimethyl ammonium chloride (CTAC) solution was added with rapid stirring to an equal weight of 2% w/w silica dispersion (Ludox SM ex Du Pont de Nemours colloidal silica having an average particle size of approximately 7 nanometers). 5 g of this mixture were then diluted by addition of 45 g distilled water.

To 45 g of this dispersion (0.1% $SiO_2$, 0.006% CTAC) were added 5 g of the ester described in example 1 followed by homogenisation using a Silverson blender as described in Example 1.

Microscopic examination showed the emulsion to contain mainly spherical droplets of size up to 50 micrometer. There was no visible coalescence, but the droplets were observed to rupture when pressure was applied to the microscope cover slip as described above.

We claim:

1. A lubricant consisting essentially of an oil-in-water emulsion and solid particles of partially hydrophobic silica, in which the oil is a lubricating material, characterized in that the oil droplets are stabilized by a surface coating of the partially hydrophobic silica particles having a size of less than 1 micrometer.

2. The lubricant according to claim 1, characterized in that the size of the particles ranges between 0.003 and 1 micrometer.

3. The lubricant according to claim 2, characterized in that the size of the particles ranges between 0.003 and 0.1 micrometer.

4. The lubricant according to claim 1, characterized in that the silica is present in the form of a brittle, rigid interfacial skin.

5. The lubricant according to claim 4, characterized in that the coated droplets of the emulsion, when subjected to distortion or asymmetric pressure, undergo an irreversible rupturing and thereby form a film of droplet material on the neighbouring surfaces.

6. The lubricant according to claim 1, characterized in that the lubricating material comprises molecules containing at least 10 carbon and/or silicon atoms.

7. The lubricant according to claim 6, characterized in that the lubricating oil is an organic ester.

8. The lubricant according to claim 7, characterized in that the organic ester is derived from a polyol comprising a tertiary alpha carbon atom.

9. The lubricant according to claim 7, characterized in that the ester is derived from $C_6$ to $C_{22}$ carboxylic acids.

10. The lubricant according to claim 1, characterized in that the percentage of lubricating material ranges between 0.1 and 70% (w/w) between on basis of the total emulsion.

11. The lubricant according to claim 1 characterized in that the amount of silica particles ranges between 0.01 and 25% (w/w) calculated on the weight of oil.

12. The lubricant according to claim 1 characterized in that the silica particles are modified using a hydrophobing agent in an amount ranging between 0.1 to 100 mg per gram of silica particles.

13. The lubricant according to claim 12, characterized in that the silica particles are modified using a hydrophobing agent in an amount ranging between 0.1 to 10 mg per gram of silica particles.

14. The lubricant according to claim 1, characterized in that it also contains additives used in hydraulic and/or other water-based functional fluids, being corrosion inhibitors, shear stabilising agents, thickeners, bactericides, dyes, water softening agents, odour masking agents, surfactants, antiwear additives, de-foamers and extreme-pressure additives.

15. Hydraulic fluid consisting essentially of an oil-in-water emulsion and solid particles of partially hydrophobic silica, in which the oil is a lubricating material, characterized in that the oil droplets are stabilized by a surface coating of the partially hydrophobic silica particles having a size of less than 1 micrometer.

16. Metal-working or metal-rolling fluid consisting essentially of an oil-in-water emulsion and solid particles of partially hydrophobic silica, in which the oil is a lubricating material, characterized in that the oil droplets are stabilized by a surface coating of the partially hydrophobic silica particles having a size of less than 1 micrometer.

17. The lubricant according to claim 10, characterized in that the percentage of lubricating material ranges between 0.5 and 20% (w/w), on the basis of the total emulsion.

18. The lubricant according to claim 11, characterized in that the amount of silica particles ranges between 0.02 and 10% (w/w), calculated on the weight of the oil.

* * * * *